US010588472B2

(12) United States Patent
Choi et al.

(10) Patent No.: US 10,588,472 B2
(45) Date of Patent: Mar. 17, 2020

(54) VACUUM CLEANER

(71) Applicant: Samsung Electronics Co., Ltd., Suwon-si, Gyeonggi-do (KR)

(72) Inventors: Ji Won Choi, Suwon-si (KR); Byoung In Lee, Suwon-si (KR); Hak Bong Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 190 days.

(21) Appl. No.: 15/857,357

(22) Filed: Dec. 28, 2017

(65) Prior Publication Data

US 2018/0184862 A1 Jul. 5, 2018

(30) Foreign Application Priority Data

Jan. 3, 2017 (KR) ..... 10-2017-0000834

(51) Int. Cl.

| | |
|---|---|
| ***A47L 5/30*** | (2006.01) |
| ***A47L 9/04*** | (2006.01) |
| ***A47L 7/00*** | (2006.01) |

(52) U.S. Cl.

CPC ..... *A47L 5/30* (2013.01); *A47L 7/0066* (2013.01); *A47L 9/0411* (2013.01); *A47L 9/0466* (2013.01); *A47L 9/0444* (2013.01)

(58) Field of Classification Search

CPC ..... A47L 7/0066; A47L 9/04; A47L 9/0477; A47L 9/0466

USPC ..... 15/383, 391

See application file for complete search history.

(56) References Cited

U.S. PATENT DOCUMENTS

| | | | | |
|---|---|---|---|---|
| 8,418,303 | B2 | 4/2013 | Kapoor et al. | |
| 2006/0150365 | A1 | 7/2006 | Ivarsson et al. | |
| 2009/0229075 | A1 | 9/2009 | Eriksson | |
| 2014/0053351 | A1 | 2/2014 | Kapoor et al. | |
| 2014/0143978 | A1 | 5/2014 | Li et al. | |
| 2017/0280957 | A1* | 10/2017 | Jeong | A47L 5/30 |
| 2019/0193120 | A1* | 6/2019 | Brown | B08B 1/005 |

FOREIGN PATENT DOCUMENTS

| | | | |
|---|---|---|---|
| CN | 203709942 | U | 7/2014 |
| CN | 104939750 | A | 9/2015 |
| CN | 105338870 | A | 2/2016 |
| CN | 205671990 | U | 11/2016 |
| DE | 102012222401 | A1 | 6/2014 |
| EP | 0313403 | A2 | 4/1989 |
| EP | 0484828 | A1 | 5/1992 |
| JP | 2003310496 | A | 11/2003 |
| JP | 3879040 | B2 | 2/2007 |
| KR | 10-2008-0051507 | A | 6/2008 |

(Continued)

OTHER PUBLICATIONS

European Search Report dated Jul. 10, 2018 in connection with European Patent Application No. 17 20 7340.

(Continued)

*Primary Examiner* — Bryan R Muller

(57) ABSTRACT

Disclosed herein is a vacuum cleaner including a brush to rotate and collect foreign materials on the floor, and a grinder to grind the foreign materials collected through the brush. Since the hair-like foreign materials wound around the brush are grinded and cut by the grinders, a cleaning cycle of the brush can be extended.

20 Claims, 7 Drawing Sheets

(56) References Cited

FOREIGN PATENT DOCUMENTS

| | | | |
|---|---|---|---|
| KR | 10-2015-0094701 | A | 8/2015 |
| KR | 10-2016-0025460 | A | 3/2016 |
| WO | 2014/094869 | A1 | 6/2014 |

OTHER PUBLICATIONS

European Patent Office, Communication pursuant to Article 94(3) EPC, Application No. EP17207340.5, dated Dec. 17, 2018, 4 pages.
European Patent Office, "Communication under Rule 71(3) EPC," Application No. EP 17207340.5, dated Oct. 31, 2019, 32 pages.
National Intellectual Property Administration of the People's Republic of China, "The First Office Action," Application No. CN201810004045.4, dated Dec. 6, 2019, 12 pages.

* cited by examiner

VACUUM CLEANER

CROSS-REFERENCE TO RELATED APPLICATION) AND CLAIM OF PRIORITY

This application is related to and claims priority to Korean Patent Application No. 10-2017-0000834, filed on Jan. 3, 2017, the contents of which are incorporated herein by reference.

TECHNICAL FIELD

Embodiments of the present disclosure relate to a vacuum cleaner including a brush rotating to sweep up foreign materials on the floor.

BACKGROUND

In general, a vacuum cleaner is an apparatus to suction in foreign materials on the floor with a suction force generated by a fan motor to thereby perform cleaning.

Vacuum cleaners can be classified into a general vacuum cleaner including a handle to enable a user to move the vacuum cleaner to suction in foreign materials on the floor, thereby cleaning the floor, and a robot cleaner which travels on an area to be cleaned according to a predetermined program instead of a user's manipulation to suction in foreign materials on the floor, thereby cleaning the floor.

A vacuum cleaner includes a brush installed in a suction opening to which a suction force of a fan motor is applied, and sweeps up foreign materials on the floor when the brush rotates to thereby easily suction in the foreign materials on the floor through the suction opening.

Since the brush rotates, hair-like foreign materials, such as stands of hair or fur, are inevitably wound around the brush.

Accordingly, a user should clean the brush periodically in order to remove hair-like foreign materials.

SUMMARY

To address the above-discussed deficiencies, it is a primary object to provide a vacuum cleaner capable of extending a cleaning cycle of a brush.

Additional aspects of the disclosure will be set forth in part in the description which follows and, in part, will be obvious from the description, or may be learned by practice of the disclosure.

In accordance with one aspect of the present disclosure to provide a vacuum cleaner including a brush configured to rotate to collect foreign materials on a floor, and at least one grinder configured to grind the foreign materials collected by the brush, wherein the brush comprises a plurality of drum portions each formed in the shape of a cylinder, a plurality of blades protruding from each of the plurality of drum portions, and at least one foreign material collector formed concavely with respect to the plurality of drum portions, an outer circumferential surface of the at least one foreign material collector facing the at least one grinder.

The brush may include a plurality of shield ribs formed in the shape of a ring at both side ends of the plurality of drum portions.

The shield ribs may be integrated into the plurality of blades.

Each of the plurality of blades may include a pair of guide portions formed at both ends of an edge of the blade and inclined with respect to both side ends of the blade.

The plurality of blades may include a plurality of protrusions protruding from the edges.

The plurality of protrusions may protrude from one surfaces of the blades corresponding to front sides in rotation direction of the brush.

Each of the plurality of protrusions may have a section of a right-angled triangle, the bottoms of the plurality of protrusions are connected to the one surfaces of the blades, and surfaces of the protrusions forming a height of the protrusions face outward in a radial direction with respect to the drum portions.

The at least one foreign material collector is in the shape of a truncated cone whose base side has a diameter that is smaller than or equal to a diameter of each drum portion.

A plurality of foreign material collectors may be respectively disposed between the plurality of drum portions, and at both side ends of the brush.

A diameter of the at least one foreign material collector may be reduced gradually toward a center portion of the brush.

The at least one grinder may include a grinding portion formed in the shape of a curved fan whose center portion is incised to correspond to the at least one foreign material collector, and a plurality of grinding blades protruding from the grinding portion toward the at least one foreign material collector.

The plurality of grinding blades may extend in directions of generating lines of the grinding portion, and are spaced from each other in a circumferential direction.

The at least one grinder may include a plurality of guide surfaces formed as concavely curved surfaces between the grinding blades.

The at least one grinder may include a pair of fixing portions respectively formed in the shape of "U" at both side ends of the grinding portion.

The vacuum cleaner may further include a body having a suction opening in which the brush is installed, at the bottom, and a cover member installed on the suction opening, and configured to cover the at least one foreign material collector.

The suction opening may be formed in the shape of a rectangle, and the cover member comprises a frame portion formed in the shape of a rectangular ring to correspond to the suction opening, and a at least one cover portion extending from the frame portion, and configured to cover a lower portion of the at least one foreign material collector.

The at least one grinder may be installed in the at least one cover portion.

The blades may extend in a spiral shape such that areas of the blades adjacent to a side end of the brush are located at a front area in rotation direction of the brush, and areas of the blades adjacent to a center portion of the brush are located at a back area in rotation direction of the brush.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
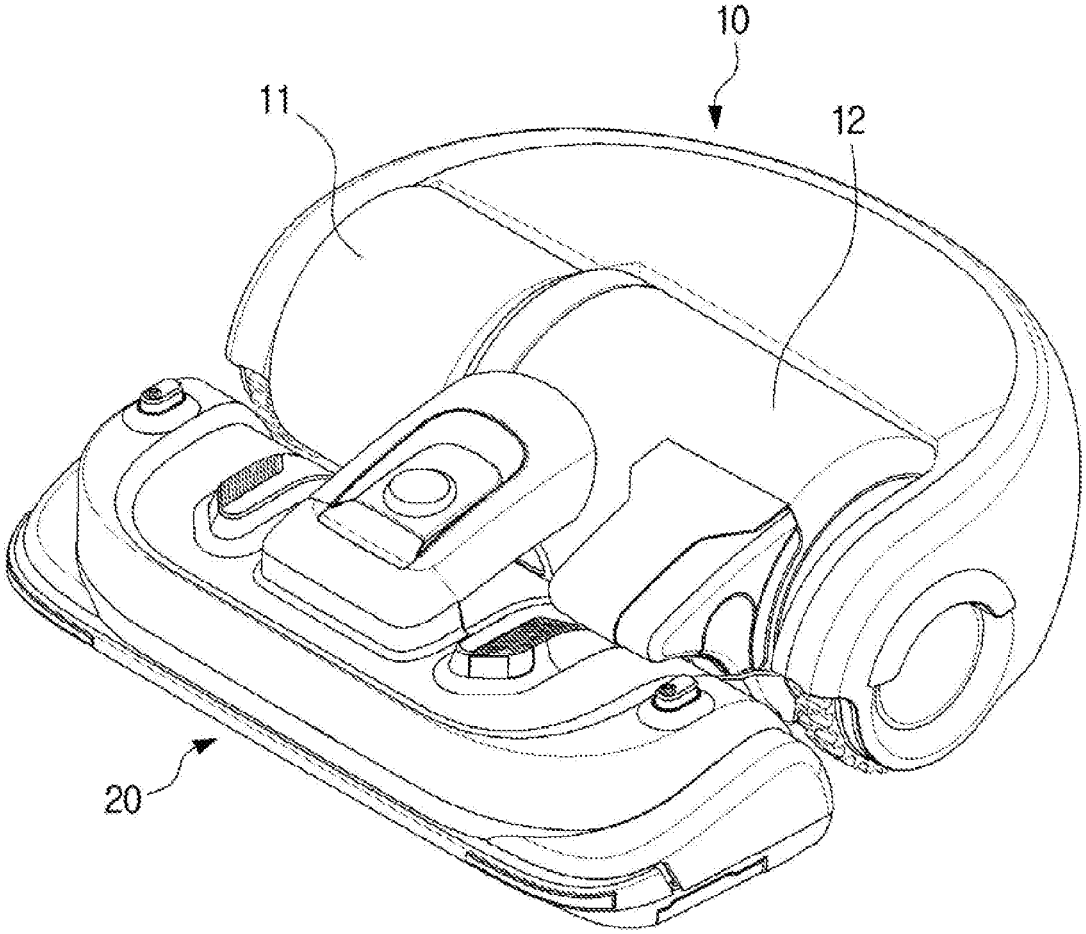
FIG. 1 is a perspective view illustrating a vacuum cleaner according to an embodiment of the present disclosure.

FIGS. 1 through 7, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are used to describe the embodiments of the present disclosure. Accordingly, it should be apparent to those skilled in the art that the following description of exemplary embodiments of the present invention is provided for illustration purpose only and not for the purpose of limiting the invention as defined by the appended claims and their equivalents. It is to be understood that the singular forms "a," "an," and "the" include plural referents unless the context clearly dictates otherwise. It will be understood that when the terms "includes," "comprises," "including," and/or "comprising." when used in this specification, specify the presence of stated features, figures, steps, components, or combination thereof, but do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

A vacuum cleaner according to an embodiment of the present disclosure may include a main body 10, and a sub body 20 disposed to a front portion of the main body 10 in a direction of movement, as shown in FIG. 1.

The main body 10 may include a fan motor 11 configured to generate a suction force to suction in foreign materials together with air, and a dust case 12 configured to filter the foreign materials suctioned together with the air and to store the foreign materials therein.

Figure 2:
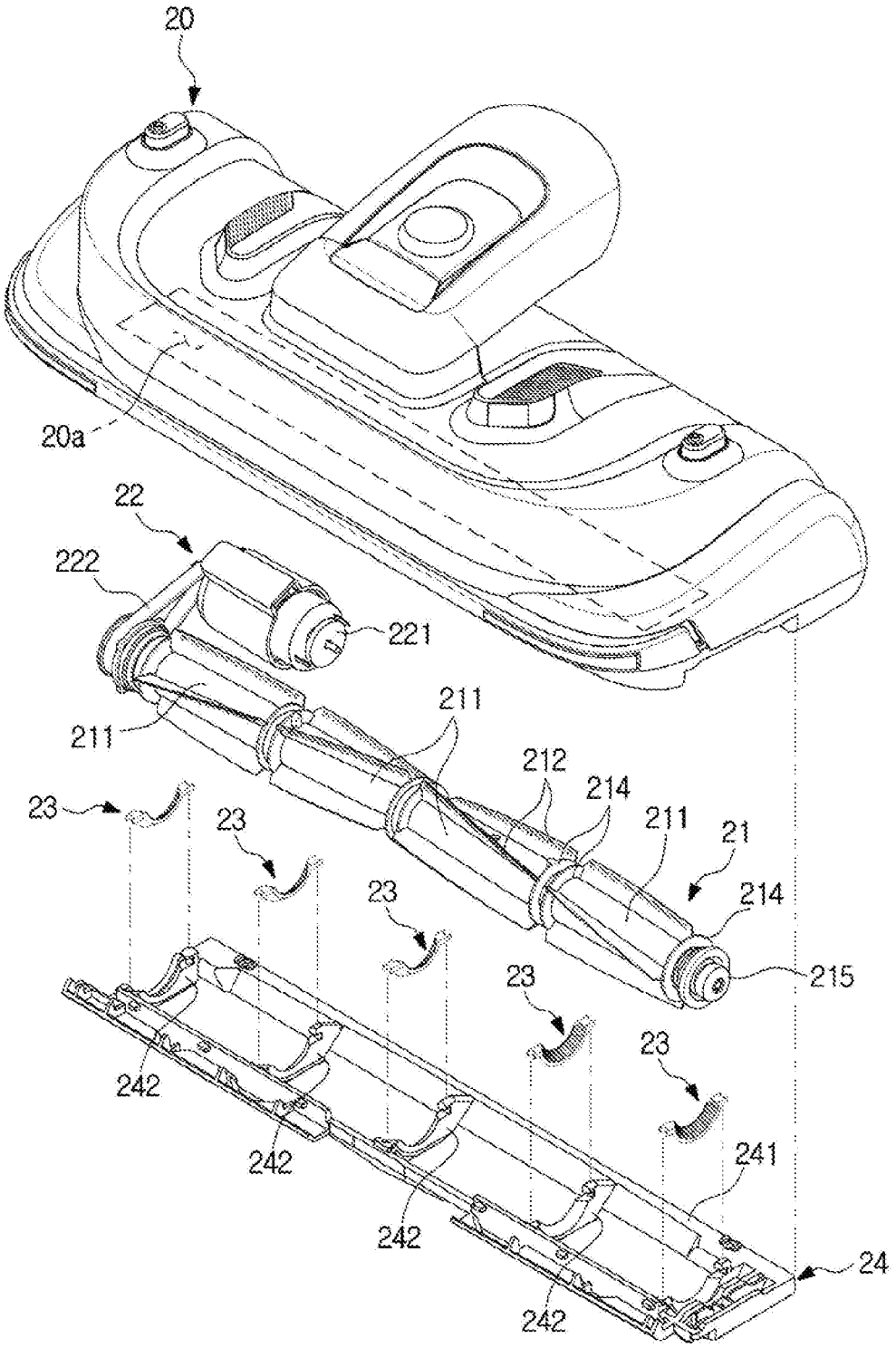
FIG. 2 is an exploded perspective view illustrating an installation state of a brush and a cover member in a vacuum cleaner according to an embodiment of the present disclosure.
Figure 3:
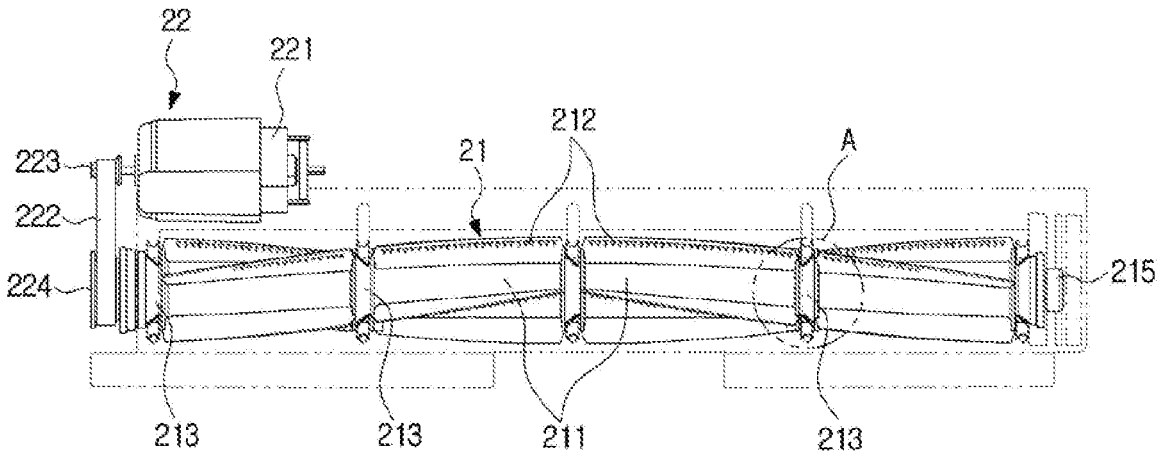
FIG. 3 is a top view illustrating a brush in a vacuum cleaner according to an embodiment of the present disclosure.

The sub body 20 may include a suction opening **20*a* which is formed in the shape of a rectangle in the bottom of the sub body 20 and into which foreign materials such as dust are suctioned together with air, as shown in FIGS. 2 and 3. The sub body 20 may include a brush 21 rotatably installed in the suction opening 20*a* and configured to rotate to sweep up dust on a floor, a driving apparatus 22 configured to rotate the brush 21, and a cover member 24 installed on the suction opening 20*a* and covering a plurality of foreign material collectors 213** which will be described later.

The brush 21 may include a plurality of drum portions 211 each formed in the shape of a cylinder, a plurality of blades 212 protruding from outer circumferential surfaces of the drum portions 211, and the foreign material collectors 213 formed concavely with respect to the drum portions 211. Also, the brush 21 may include a power transfer portion (not shown) disposed at one end and coupled with a driven pulley 224 which will be described later to receive power from the driving apparatus 22, and a bearing cap 215 disposed at the other end and including a bearing (not shown) therein. The bearing cap 215 may be rotatably installed in the sub body 20 through the cover member 24.

The plurality of drum portions 211 and the plurality of foreign material collectors 213 may be arranged alternately.

In the current embodiment, four drum portions 211 may be disposed, and the blades 212 may respectively extend integrally from the outer circumferential surfaces of the drum portions 211. On each drum portion 211, a plurality of blades 212 may be arranged in such a way to be spaced from each other in a circumferential direction.

The blades 212 may be formed of an elastically deformable material, so that when the brush 21 rotates, some edge areas of the blades 212 contact a floor surface to be deformed.

In the current embodiment, the blades 212 may be formed in a spiral shape such that areas of the blades 212 adjacent to a side end of the brush 21 are located at a front area in rotation direction of the brush 21, and areas of the blades 212 adjacent to the center portion of the brush 21 are located at a back area in rotation direction of the brush 21. The spiral shape of the blades 212 may be aimed to move hair-like foreign materials toward the center portion of the brush 21 when the brush 21 rotates.

Figure 4:
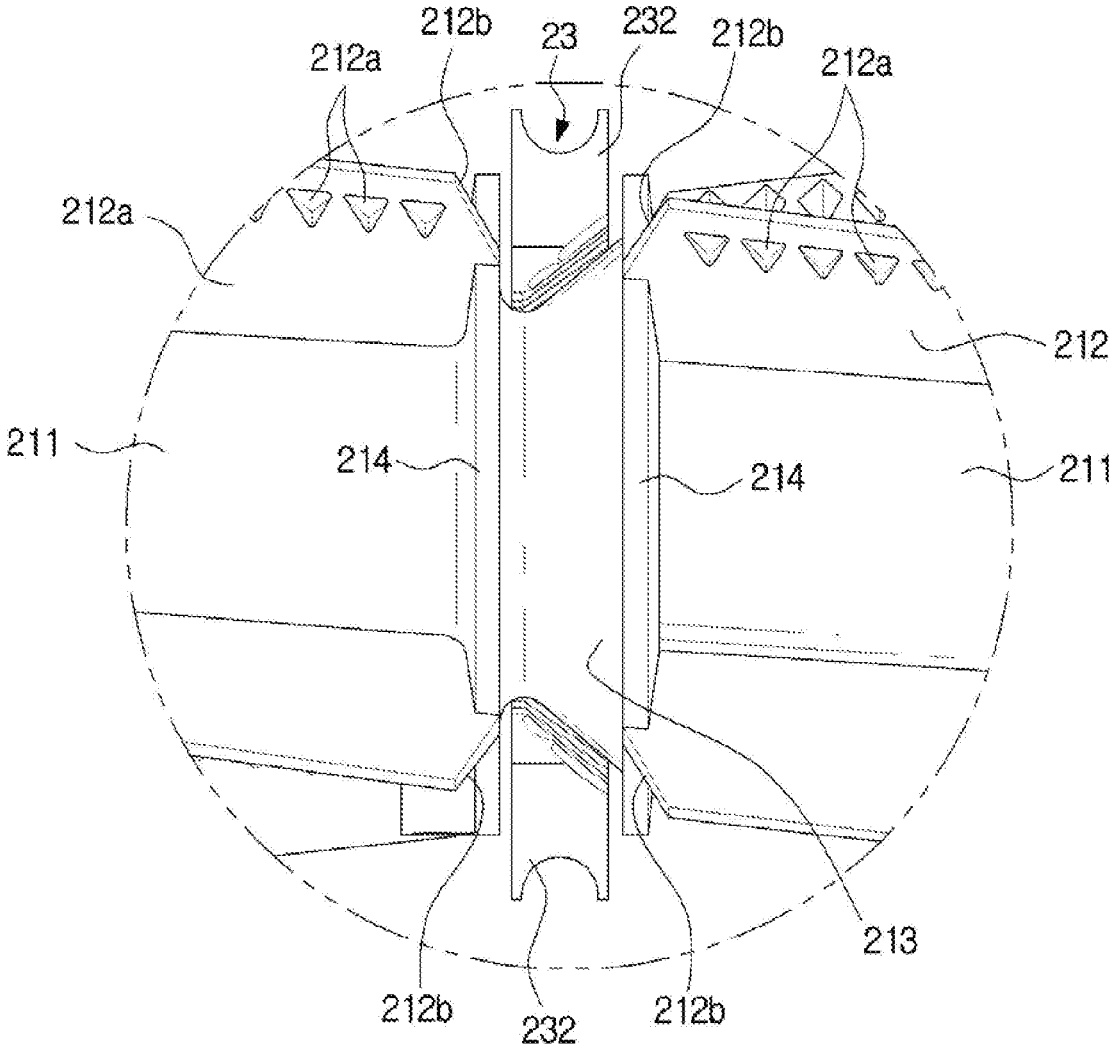
FIG. 4 is an enlarged view illustrating an area A of FIG. 3.
Figure 5:
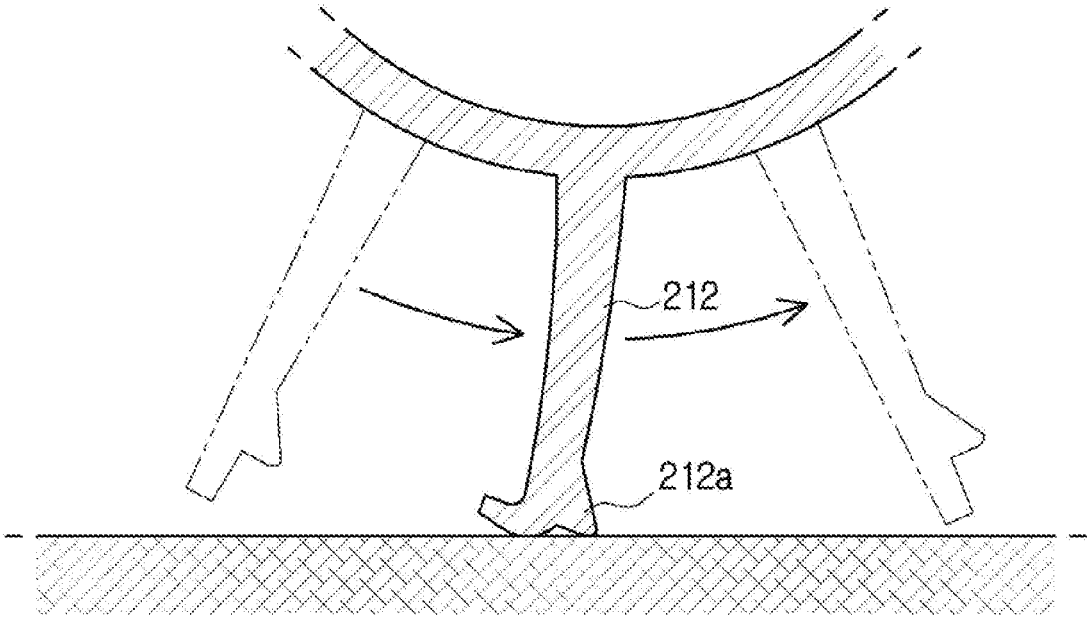
FIG. 5 is a cross-sectional view illustrating operation of protrusions formed on a blade in a vacuum cleaner according to an embodiment of the present disclosure.

On some edge areas of the blades 212, a plurality of protrusions 212*a* may be formed to easily sweep up foreign materials on a floor surface, as shown in FIGS. 4 and 5.

The protrusions 212*a* may protrude from one surfaces of the blades 212 corresponding to front sides in rotation direction of the brush 21, and each protrusion 212*a* may have a section of a right-angled triangle. The bottoms of the protrusions 212*a* may be connected to the one surfaces of the blades 212, and the surfaces of the protrusions 212*a* forming the height of the protrusions 212*a* may face outward in a radial direction with respect to the drum portions 211.

Since hair-like foreign materials are more easily caught by the protrusions 212*a* due to the above-described shape of the protrusions 212*a*, it is possible to more efficiently clean hair-like foreign materials existing on the floor.

Also, each blade 212 may include a pair of guide portions 212*b* formed at both ends of the edge and inclined with respect to both side ends.

In the current embodiment, the guide portions 212*b* may be in the shape of a straight line inclined with respect to both side ends of the blade 212, so that hair-like foreign materials can easily move along the guide portions 212*b*, and accordingly, the hair-like foreign materials can be easily separated from the blade 212.

Also, the guide portions 212*b* may be located adjacent to the foreign material collectors 213, so as to guide hair-like foreign materials to the foreign material collectors 213.

Referring again to FIG. 3, five foreign material collectors 213 including three foreign material collectors 213 disposed between the four drum portions 211 and two foreign material collectors 213 disposed at both ends of the brush 21 may be provided.

The foreign material collectors 213 may be in the shape of a truncated cone whose diameter reduces gradually from one end toward the other end, as shown in FIG. 4. In the current embodiment, the diameter of each foreign material collector 213 may be reduced gradually toward the center portion of the brush 21.

Accordingly, if hair-like foreign materials are collected in the foreign material collectors 213, a part of the foreign materials may move to the center portion of the brush 21 by the foreign material collectors 213.

Particularly, when hair-like foreign materials are collected in the foreign material collectors 213 located at both side ends of the brush 21 adjacent to the power transfer portion and the bearing cap 215, the hair-like foreign materials can move away from the power transfer portion and the bearing cap 215. Accordingly, a reduction in rotation speed of the brush 21 which occurs when hair-like foreign materials is wound around the power transfer portion and the bearing cap 215 can be prevented.

Figure 6:
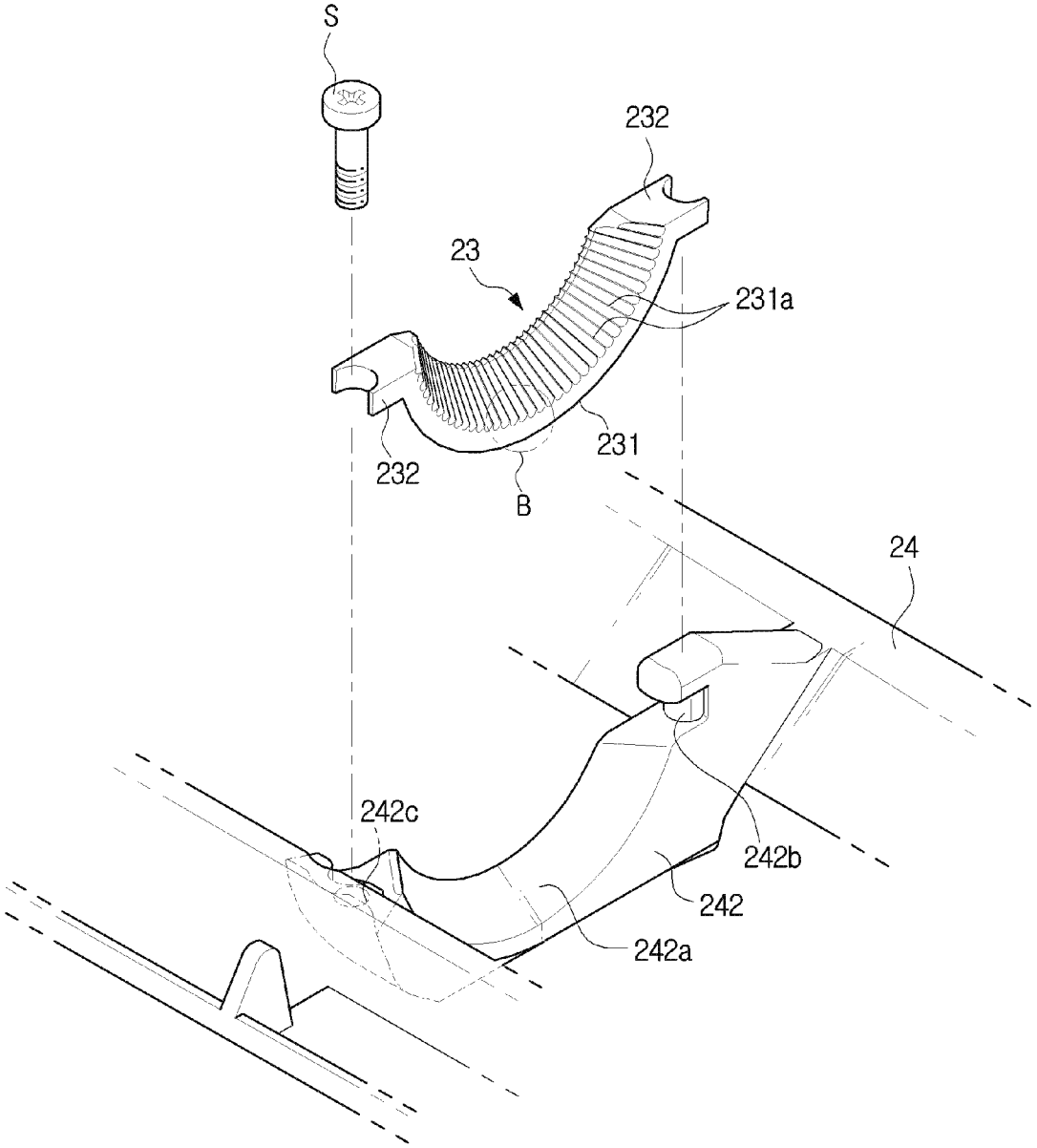
FIG. 6 is an exploded perspective view illustrating an installation state of a grinder in a vacuum cleaner according to an embodiment of the present disclosure.

Also, the vacuum cleaner according to the present disclosure may include a grinder 23 facing an outer circumferential surface of each foreign material collector 213, and configured to grind foreign materials collected in the foreign material collector 213, as shown in FIG. 6.

The grinder 23 may be in the shape of a curved fan whose center portion is incised to correspond to the outer circumferential surface of the foreign material collector 213 formed in the shape of a truncated cone. The grinder 23 may include a grinding portion 231 whose inner circumferential surface faces the foreign material collector 213, and a pair of fixing portions 232 formed at both side ends of the grinding portion 231 and used to install the grinder 23 in the cover member 24.

The grinding portion 231 may include a plurality of grinding blades 231*a* protruding toward the foreign material collector 213 from the inner circumferential surface, spaced a predetermined distance from the outer circumferential surface of the foreign material collector 213, and configured to grind foreign materials. The grinding blades 231*a* may extend in directions of generating lines of the grinding portion 231 and be spaced from each other in a circumferential direction.

Figure 7:
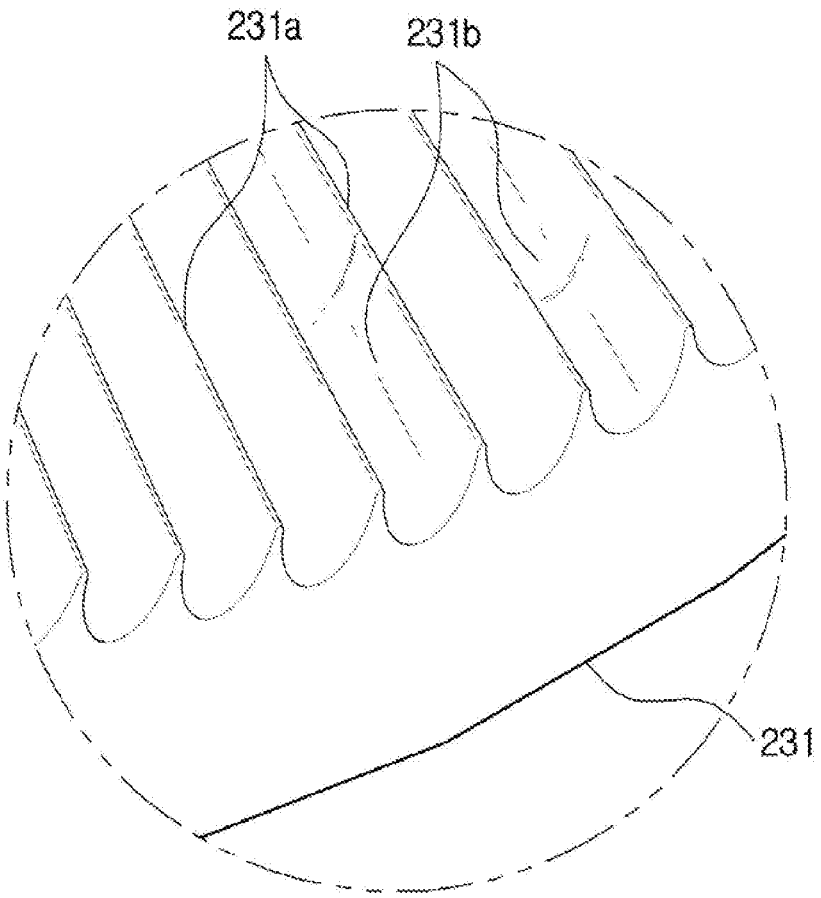
FIG. 7 is an enlarged view illustrating an area B of FIG. 6.

Also, the grinding portion 231 may include a plurality of guide surfaces 231*b* formed as concavely curved surfaces between the grinding blades 231*a*, as shown in FIG. 7. Foreign materials grinded by the grinding blades 231*a* may move along the guide surfaces 231*b* formed as curved surfaces so as to be easily suctioned into the suction opening 20*a*.

Accordingly, when the brush 21 rotates, hair-like foreign materials may enter space between the foreign material collector 213 and the grinder 23. Then, the foreign materials may rotate together with the brush 21 to be grinded or cut by the grinding blades 231*a* of the grinder 23, and then be suctioned into the suction opening 20*a* together with air by a suction force applied to the suction opening 20*a*.

As such, since a major part of hair-like foreign materials wound around the brush 21 are grinded and cut by the grinder 23 and then suctioned, a cleaning cycle of the brush 21 can extend significantly.

The fixing portions 232 may be respectively formed in the shape of "U" at both side ends of the grinding portion 231. One of the fixing portions 232 may be caught by a catching groove 242*b* of the cover member 24 which will be described later to be supported on the cover member 24, and the other one of the fixing portions 232 may be fixed on the cover member 24 by a coupling member such as a screw S.

If a foreign material that is larger than an appropriate size enters the space between the foreign material collector 213 and the grinder 23, the foreign material may be caught between the foreign material collector 213 and the grinder 23. In this case, the brush 21 may not rotate smoothly.

Accordingly, the brush 21 may include a plurality of shield ribs 214 formed in the shape of a ring at both side ends of each drum portion 211. The shield ribs 214 may be integrated into the blades 212, and spaced a predetermined distance from a floor to be cleaned. The shield ribs 214 may be formed of an elastically deformable material, like the blades 212.

Accordingly, the shield ribs 214 may allow foreign materials having sizes that are smaller than or equal to a predetermined size to enter the foreign material collectors 213 through space between the shield ribs 214 and the floor, while preventing foreign materials having sizes that are larger than the predetermined size from entering the foreign material collectors 213.

The cover member 24 may include, as shown in FIG. 2, a frame portion 241 formed in the shape of a rectangular ring to correspond to the suction opening 20*a* and installed on the suction opening 20*a*, and a plurality of cover portions 242 extending inwardly from the frame portion 241 to cover the lower portions of the foreign material collectors 213. The cover portions 242 may be arranged in correspondence to the plurality of foreign material collectors 213 so that the cover member 24 has a lattice shape.

Accordingly, it is possible to prevent foreign materials on the floor from being directly transferred to the space between the grinders 23 and the foreign material collectors 213. Also, since the grinders 23 and the foreign material collectors 213 are covered with the cover portions 242, a user cannot see the grinders 23 and the foreign material collectors 213.

The grinders 23 may be respectively installed in the cover portions 242 of the cover member 24, as shown in FIG. 6.

In order to install the grinders 23, each cover portion 242 may include a resting groove 242*a* which is formed in the upper surface of the cover portion 242 and on which the grinding portion 231 of the grinder 23 is rested, a catching groove 242*b* which one of the fixing portions 232 of the grinder 23 is caught by and supported on, and a coupling hole 242*c* to fix the other one of the fixing portions 232 of the grinder 23 through a bolt B.

Accordingly, the grinder 23 may be fixed on the upper surface of the cover portion 242 and disposed below the foreign material collector 213.

The driving apparatus 22 may include, as shown in FIG. 2, a driving motor 221 to generate a rotational force, a belt 222 to transfer a rotational force of the driving motor 221 to the brush 21, a driving pulley 223 connected to a shaft of the driving motor 221, and the driven pulley 224 connected to the power transfer portion of the brush 21. In the current embodiment, the belt 222 may be a timing belt, and in the driving pulley 223 and the driven pulley 224, a gear may be formed.

In the current embodiment, the grinders 23 are disposed below the foreign material collectors 213. However, the grinders 23 may be disposed above the foreign material collectors 213, in front of the foreign material collectors 213, or behind the foreign material collectors 213.

In the current embodiment, the vacuum cleaner includes the main body 10 including the fan motor 11 and the dust case 12, and the sub body 20 in which the brush 21 is installed, and the suction opening 20*a* is formed in the bottom of the sub body 20. However, the brush 21 and the grinders 23 according to the present disclosure can also be applied in the same way to the case in which the vacuum cleaner includes a single body having a suction opening at the bottom.

In the current embodiment, the guide portions 212*b* may be in the shape of a straight line inclined with respect to both side ends of the blades 212. However, the guide portions 212*b* may be curved.

As described above, since the vacuum cleaner according to the present disclosure grinds hair-like foreign materials wound around the brush through the grinders, it is possible to extend a cleaning cycle of the brush.

Although a few embodiments of the present disclosure have been shown and described, it would be appreciated by those skilled in the art that changes may be made in these embodiments without departing from the principles and spirit of the disclosure, the scope of which is defined in the claims and their equivalents.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A vacuum cleaner comprising:

a brush configured to rotate to collect foreign materials on a floor; and at least one grinder configured to grind the foreign materials collected by the brush, wherein the brush comprises a plurality of drum portions each formed in a shape of a cylinder, a plurality of blades protruding from each of the plurality of drum portions, and at least one foreign material collector formed between respective drum portions and having an outward facing circumferential surface with a radially recessed portion thereon, facing a respective grinder.

2. The vacuum cleaner according to claim 1, wherein the brush comprises a plurality of shield ribs formed in a shape of a ring at both side ends of the plurality of drum portions.

3. The vacuum cleaner according to claim 2, wherein the shield ribs are integrated into the plurality of blades.

4. The vacuum cleaner according to claim 1, wherein each blade of the plurality of blades comprises a pair of guide portions formed at both ends of an edge of the blade and inclined with respect to both side ends of the blade.

5. The vacuum cleaner according to claim 1, wherein the plurality of blades comprise a plurality of protrusions protruding from edges of each of the plurality of blades.

6. The vacuum cleaner according to claim 5, wherein the plurality of protrusions protrude from one surface of the blades corresponding to front sides in rotation direction of the brush.

7. The vacuum cleaner according to claim 6, wherein each of the plurality of protrusions has a section of a right-angled triangle, bottoms of the plurality of protrusions are connected to the one surface of the blades, and surfaces of the protrusions forming a height of the protrusions face outward in a radial direction with respect to the drum portions.

8. The vacuum cleaner according to claim 1, wherein at least a portion of the at least one foreign material collector is in a shape of a truncated cone.

9. The vacuum cleaner according to claim 8, wherein a plurality of foreign material collectors are respectively disposed between the plurality of drum portions and at both side ends of the brush.

10. The vacuum cleaner according to claim 9, wherein a portion of the at least one foreign material collector is reduced gradually toward a center portion of the brush.

11. The vacuum cleaner according to claim 8, wherein the at least one grinder comprises a grinding portion formed in a shape of a curved fan whose center portion is incised to correspond to the at least one foreign material collector, and a plurality of grinding blades protruding from the grinding portion toward the at least one foreign material collector.

12. The vacuum cleaner according to claim 11, wherein the plurality of grinding blades extend in directions of generating lines of the grinding portion, and are spaced from each other in a circumferential direction.

13. The vacuum cleaner according to claim 12, wherein the at least one grinder comprises a plurality of guide surfaces formed as concavely curved surfaces between the grinding blades.

14. The vacuum cleaner according to claim 11, wherein the at least one grinder comprises a pair of fixing portions respectively formed in a shape of a "U" at both side ends of the grinding portion.

15. The vacuum cleaner according to claim 1, further comprising:

a body having a suction opening in which the brush is installed, at a bottom; and a cover member installed on the suction opening, and configured to cover the at least one foreign material collector.

16. The vacuum cleaner according to claim 15, wherein the suction opening is formed in a shape of a rectangle, and the cover member comprises a frame portion formed in a shape of a rectangle to correspond to the suction opening, and at least one cover portion extending from the frame portion, and configured to cover a lower portion of the at least one foreign material collector.

17. The vacuum cleaner according to claim 16, wherein the at least one grinder is installed in the at least one cover portion.

18. The vacuum cleaner according to claim 1, wherein:

the blades extend in a spiral shape such that areas of the blades adjacent to a side end of the brush are positioned at a different circumferential location than areas of the blades adjacent to a center portion of the brush are located at a back area in rotation direction of the brush.

19. A vacuum cleaner comprising:

a fan motor configured to generate a suction force to suction in foreign materials together with air;

a brush configured to rotate to collect the foreign materials on a floor; and at least one grinder configured to grind the foreign materials collected by the brush, wherein the brush comprises:

a plurality of drum portions each formed in a shape of a cylinder, a plurality of blades protruding from each of the plurality of drum portions, and at least one foreign material collector formed between respective drum portions and having an outward facing circumferential surface with a radially recessed portion thereon, the radially recessed portion facing a respective grinder.

20. The vacuum cleaner according to claim 19, wherein the brush comprises a plurality of shield ribs formed in a shape of a ring at both side ends of the plurality of drum portions.

* * * * *